United States Patent [19]

Cooper et al.

[11] Patent Number: 4,546,245

[45] Date of Patent: Oct. 8, 1985

[54] ELECTRONIC CONTROLLER

[75] Inventors: Ellis Cooper; Gerald Lindahl, both of New York, N.Y.

[73] Assignee: Joseph A. Barbosa, New York, N.Y.

[21] Appl. No.: 495,165

[22] Filed: May 17, 1983

Related U.S. Application Data

[63] Continuation-in-part of Ser. No. 95,622, Nov. 19, 1979, abandoned.

[51] Int. Cl.[4] ..... H01J 40/14

[52] U.S. Cl. ..... 250/211 K; 84/DIG. 19; 84/1.18; 250/221

[58] Field of Search ..... 84/1.8, DIG. 19; 250/211 R, 221

[56] References Cited

U.S. PATENT DOCUMENTS 3,086,122 4/1963 Jones ..... 84/DIG. 19

3,258,601 6/1966 Suleski ..... 250/211 K 3,358,150 12/1967 Summer ..... 250/211 K 3,539,816 11/1970 Chamberlin ..... 250/211 K 3,800,059 3/1974 Pavig ..... 84/DIG. 19

*Primary Examiner*—Norman Morgenstern

*Assistant Examiner*—Janyce A. Bell

*Attorney, Agent, or Firm*—A. A. Saffitz

[57] ABSTRACT

A two hand operated instrument, for controlling electronic music synthesizers, video games and computers, capable of producing two independent control voltages, in addition to the signals produced by keyboards held in each hand, such additional control voltages actuated by rotating and telescoping the concentric tubes with respect to each other. In musical applications, the finger operated voltage signals may be used to select notes and the twist and telescope signals to control musical parameters, such as volume, pitch, timbre, pulse, width, spatial location, etc.

4 Claims, 5 Drawing Figures

ELECTRONIC CONTROLLER

This application is a continuation in part of Ser. No. 095,622 filed Nov. 19, 1979, now abandoned, for a Electronic Music Controller, which is directed to the use of the invention for controlling music synthesizers. The instrument, however, is useful with any apparatus actuated by a plurality of independent control voltages, such as video games and computers, and this application is directed to such other uses.

FIELD OF INVENTION

This invention relates to controllers for electronic musical instruments, video games and computers. In musical applications the present invention relates to hand operated devices for producing voltages for controlling notes, as well as pitch, timbre, pulse width, spatial locations or other musical parameters. In video game applications, the invention relates to so-called "joy stick" controllers.

BACKGROUND OF THE INVENTION

The most common type of controller for music synthesizers is the piano type keyboard, a long row of single pole single throw switches with one side in common, actuated by piano-key type lever mechanisms, with related voltage divider, control, envelope generator and voltage controlled oscillator circuits.

There are also ribbon type controllers, which permit continuously varying control signals to be derived from linear motion of a hand across a voltage divider.

Controllers have also been designed to imitate other musical instruments, including harmonicas, guitars, trumpets and flutes.

The prior art electronic music controller, e.g., a depressed key, produces a control voltage and a trigger pulse. The control voltage determines frequency and the trigger pulse a pre-selected envelope. Knobs, switches and patch cords are separate controls for musical parameters. A single operator can only operate two keyboards at a time, and thus is limited to two control voltages and two "triggers."

This limitation also does not permit the "bending" of notes or the playing of chords.

The prior art video game controller, referred to as a "joy stick" includes the "discrete controller," which contains four switches at the four main compass points. When tilted to the left, it instructs movement of the video character to the left, but it can only instruct in one of eight directions—the four compass points and diagonals, and cannot instruct how far or how fast the character should move.

"Proportional" joy sticks can be varied, like the volume control of a radio, permitting direction, speed and distance in any direction.

The "trackball" controller, operated by rolling the palm over a billiard ball protruding from a box, allows movement in all directions, at speeds determined by how fast the ball is spun. The spinning ball turns two shafts, controlling vertical and horizontal movement on the screen. Attached to the shafts are wheels with holes through which light shines on a photocell activating the video character.

Conventional joy sticks have only one firing button.

OBJECTS OF THE INVENTION

Accordingly, a principal object of the present invention is to provide an improved instrument capable of producing additional control voltages which may be used to control additional musical parameters, wherein many of the problems of the prior art referred to above are overcome.

Another object of the present invention is to eliminate the necessity in musical controllers for knobs, patches and switches to control timbre, volume, envelope shape, spatial location, and other parameters.

Another object of the invention is to free the performer from the synthesizer console improving audience contact.

Another object is to provide an improved, flexible, versatile "joy stick" controller for video games.

Another object is to provide a simple device, of inexpensive construction.

SUMMARY OF THE INVENTION

In accordance with the invention, there is provided an instrument comprising two concentric cylinders which can be rotated and telescoped with respect to each other.

The controller, in accordance with the invention, when provided with two hand held keyboards, achieves maximum effectiveness. Each cylinder may be provided on its curved surface with eight pressure sensitive keys, comfortably spaced from each other. The pressure sensitive switches may be of conductive elastomer overlying and spaced from a printed circuit, yielding not only on-off action which may be used to control a note, but also a pressure sensitive control voltage which may be used to control any electronic music parameter. In video games, the control voltages may instruct speed, distance, direction or act as a firing button.

The outer cylinder has two spaced photocells and opposing, corresponding constant light sources, e.g., light emitting diodes. The inner cylinder is a variable density optical filter operated by twisting, yielding a first control voltage, and/or telescoping, yielding a second independent control voltage.

These control voltages, dramatically expand the options for the synthesizer performer, video game player or computer operator.

DESCRIPTION OF THE DRAWINGS

Other objects and advantages of the invention will become apparent upon reading the following detailed description and accompanying drawings, in which.

DETAILED DESCRIPTION

Figure 1:
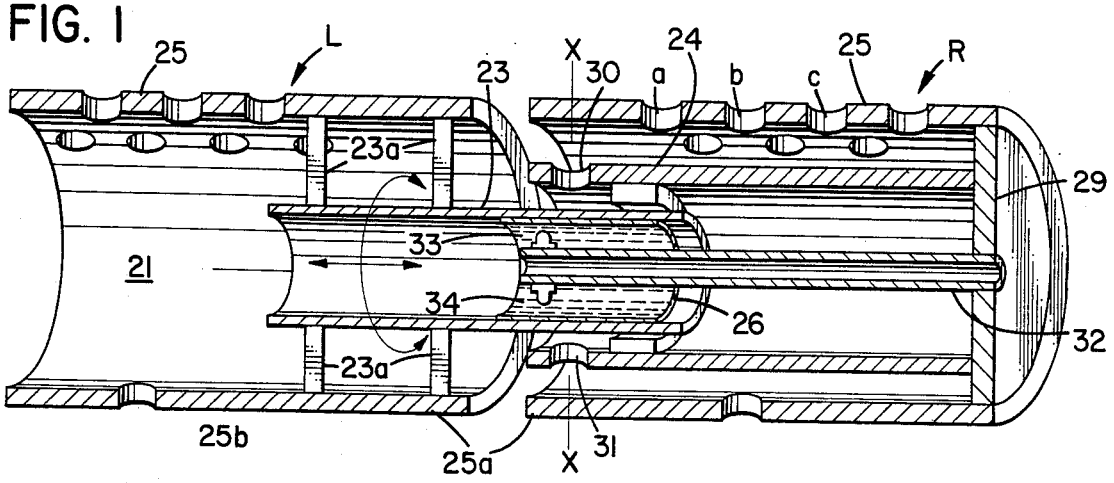
FIG. 1 is a longitudinal section of a tubular controller exemplifying the invention.

Referring now to the drawings, FIG. 1 shows a tubular controller 21 constructed in accordance with the invention. Controller 21 comprises two hand held concentric cylindrical sections, L and R respectively, portions of which telescope and rotate with respect to each other within limits. In FIG. 1, the left section, L, has affixed to it by rigid rods 23*a*, an inner cylinder 23 which protrudes from left section L and is insertable into an outer cylinder 24 of the right section, R. The rigid rods 23*a* may simply be set screws holding inner cylinder 23 rigidly in place relative to left section L, permitting disassembly of section L and inner cylinder 23 when desired. The outer cylinder 24, attached at one end to hand held section R by its base plate 29, is provided with circular spacing pads 24*a* which guide the inner cylinder 23 as it telescopes within outer cylinder 24. It is apparent, of course, that the inner cylinder 23 could be attached to section R and the outer cylinder 24 could be attached to section L without disturbing the operation. Each cylindrical section, L and R, has a hand grip and key board portion 25 provided with eight pressure sensitive keys a, b, c, d, e, f, g, and h, which are comfortably spaced for fingering, and the structure of which is shown in greater detail in FIG. 5 as described below. The hand grip and keyboard sections 25 of section L and R may be of identical diameter and length. At or near the free end of cylinder 24 are mounted photoresistors 30 and 31 spaced at 180° from each other and connected to conventional resistance responsive circuitry, now shown, to provide control voltages. Also mounted on the baseplate 29 is a tubular post 32, at the free end of which light sources, such as light emitting diodes, 33 and 34, are attached facing and illuminating photoresistors 30 and 31. A power supply for the light sources 33 and 34, connected through the tubular post 29 is not shown.

Figure 3:
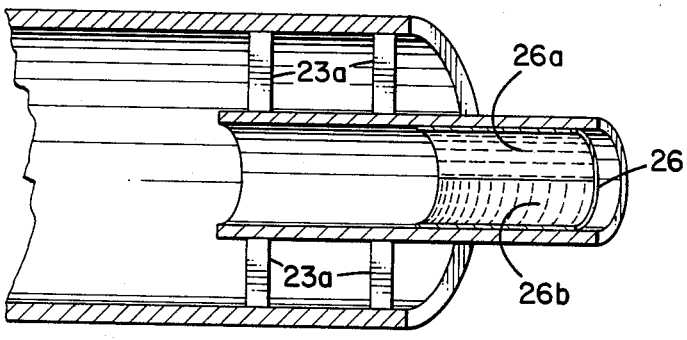
FIG. 3 is an enlarged view of the variable density optical filter.

Inner cylinder 23 is made of transparent material and mounted thereon is a cylindrical variable density optical filter 26, shown in greater detail in FIG. 3.

Inner cylinder 23 can telescope within outer cylinder 24 within limits. If the hand held sections L and R are of identical diameter, as shown in FIG. 1, the controller may be "closed" by telescoping these sections together guided by pads 24*a* so that the cylinder 23 is fully nested within outer cylinder 24. Separation may be prevented by an appropriate pin and stop mechanism, such as is shown in FIG. 2.

Figure 2:
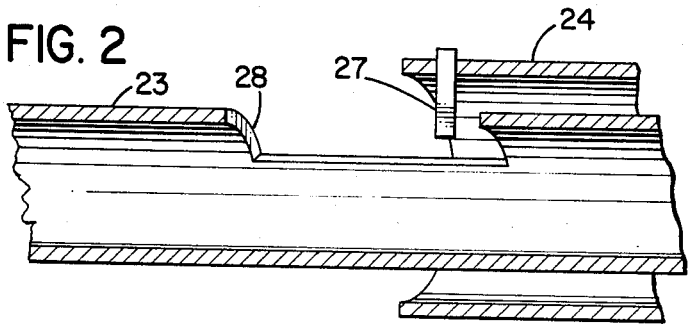
FIG. 2 is a sectional view of a stop mechanism for the tubular controller.

In FIG. 2, pin 27 is affixed at or near the extremity of outer cylinder 24 and is moveable within a semi-cylindrical cut out portion 28 of inner cylinder 23, the periphery of which defines the locus or field within which inner cylinder 23 and outer cylinder 24 may rotate and telescope with respect to each other. Thus, with a semi-cylindrical portion cut away, rotation of inner cylinder 23 and its filter 26 within outer cylinder 24 is limited to 180°.

FIG. 3 shows the variable density optical filter 26 in greater detail. In a preferred embodiment of the invention, as shown in FIG. 3, filter 26 is cylindrical and is divided into two optically graduated semi-cylinders. In one semi-cylinder 26*a*, opacity increases continuously along the circumference of semi-cylinder 26*a* and on the second semi-cylinder 26*b*, opacity increased continuously along its length.

By positioning the photoresistors 30 and 31 180° apart and using the preferred filter 26 described above, the control voltages secured are independent.

Figure 4:
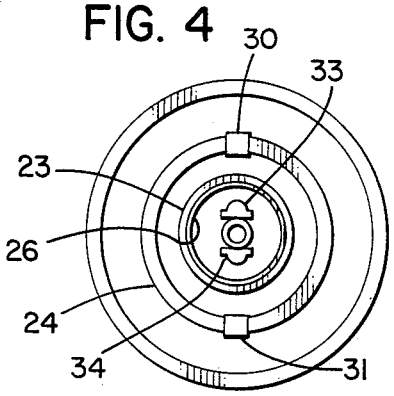
FIG. 4 is a transverse section of the concentric cylinders of the controller taken at section X—X, in FIG. 1.

FIG. 4, a transverse section of the controller in accordance with this preferred embodiment taken along section X—X as shown in FIG. 1, shows outer cylinder 24 holding photoresistors 30 and 31 spaced apart by 180° and separated from their associated light sources 33 and 34 by optical filter 26.

In the preferred embodiment, shown in FIGS. 1–3, the continuously graduated semi-cylinders 26*a* and 26*b* of filter 26 rotate only 180° before photoresistors 30 and 31, respectively, and are so positioned that the range of opacity of semi-cylinder 26*a* varies from minimum to maximum within the 180° of rotation. Likewise, upon opening the controller, the range of opacity of semi-cylinder 26*a* varies from minimum to maximum within the range of extension of telescoping. This preferred embodiment yields two independent control voltages. Of course, the optical filter 26 may have any designed or random variation in opacity, its rotation may be unlimited and novel and interesting musical or video effects of a random nature may be achieved.

Figure 5:
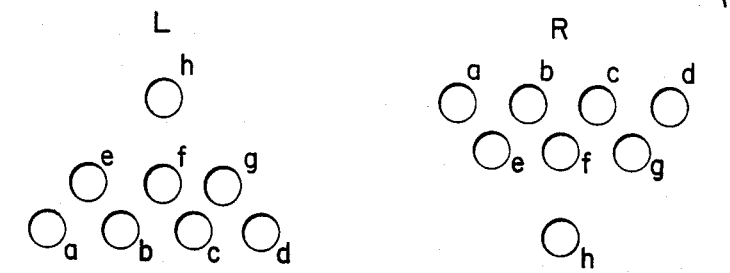
FIG. 5 is an enlarged view of the hand grip and keyboard section surrounding the outer cylinder of the controller showing the spaced arrangement of the keys for the right and left hands.

Referring to FIG. 5, an enlarged view of the hand grip and keyboard portion 25 of section L and R, which may be used in conjunction with the invention, each keyboard has eight sensitive keys, a-h, comfortably spaced for depression by the thumb and fingers while holding the controller 21. These keys may be pressure sensitive as disclosed in U.S. Pat. No. 4,044,642 issued Aug. 30, 1977 to Pearlman et al. Such keys may be used to select notes and trigger ADSR envelopes.

Thus each hand held section L or R of the controller described above may produce notes with envelopes. In conjunction with the preferred embodiment of the invention shown in FIGS. 1–4, a performer may also control volume, pitch, timbre, pulse width, special location or other musical parameters.

Used as a video game "joy stick," the controller may be rotated or telescoped at varying speeds to control horizontal and vertical movement at varying speeds and the keys may be used to fire from one or more sources, or to control other game parameters.

The invention may be embodied in other specific forms without departing from the spirit or essential characteristics thereof, as the present embodiments are merely illustrative and not restrictive.

What is claimed is:

1. In an electronic controller utilizing photovariable resistance, and outer cylinder provided with a first light source and first photoresistor and a second light source and second photoresistor, said photoresistors and light sources spaced and opposed within said outer cylinder, a variable density filter comprises a portion of a concentric inner cylinder, a first semi-cylinder of said filter varying in intensity along its circumference and movable between said first light source and first photoresistor, the second semi-cylinder of said filter varying in intensity along its length and movable between said second light source and second photoresistor, whereby rotating said filter varies the intensity of light upon said first photoresistor, and telescoping of said filter varies the intensity of light upon said second photoresistor.

2. The electronic controller of claim 1 in which said inner and outer cylinders are provided with stop means for limiting the rotational motion of said inner and outer cylinders with respect to each other to 180 degrees.

3. The controller of claim 1, in which the photovariable resistance is used to control musical parameters in an electronic musical instrument.

4. The controller of claim 1 in which the photovariable resistance is used to control videogame parameters.

* * * * *